United States Patent [19]

Starr

[11] Patent Number: 4,982,813

[45] Date of Patent: Jan. 8, 1991

[54] SHOCK ABSORBING SAFETY NET

[75] Inventor: John F. Starr, Middle Haddam, Conn.

[73] Assignee: SINCO, Incorporated, East Hampton, Conn.

[21] Appl. No.: 535,182

[22] Filed: Jun. 8, 1990

[51] Int. Cl.[5] ..... E04G 21/32; A62B 1/22

[52] U.S. Cl. ..... 182/138; 182/82

[58] Field of Search ..... 182/137, 138, 139, 140, 182/82

[56] References Cited

U.S. PATENT DOCUMENTS

| | | | |
|---|---|---|---|
| 567,642 | 9/1896 | Fitzhugh | 182/138 |
| 590,083 | 9/1897 | Alling | 182/139 |
| 3,031,688 | 5/1962 | Southwood | 182/139 |
| 3,527,319 | 9/1970 | Pedley | 182/139 |
| 3,949,834 | 4/1976 | Nusbaum | 182/138 |
| 4,074,791 | 2/1978 | Inman | 182/138 |
| 4,732,234 | 3/1988 | Brickman | 182/138 |

*Primary Examiner*—Reinaldo P. Machado

*Attorney, Agent, or Firm*—Chilton, Alix & Van Kirk

[57] ABSTRACT

A shock absorbing safety net includes diamond mesh netting which is attached to a perimeter rope. In one embodiment, groups of diamond points or peripheral diamond mesh arrays are alternately lashed and laced to the perimeter rope. The laced diamond meshes are disposed in the vicinity of snap hooks employed to attach the safety net to the support cable or mounting frame.

17 Claims, 3 Drawing Sheets

SHOCK ABSORBING SAFETY NET

BACKGROUND OF THE INVENTION

This invention relates generally to safety nets which are employed to catch a falling object or person. More.,particularly, the present invention relates generally to safety nets which are employed to catch a falling person without imparting serious injury to the person.

Safety nets have long been employed to minimize the risk of serious injury or death from accidental falling at construction sites and other hazardous structures. The safety nets are typically mounted below the areas from which an accidental fall may potentially occur. Such safety nets are commonly required at construction sites to protect the construction workers as well as the general public.

While conventional safety nets have prevented a number of accidental deaths and very serious injuries, it is well established that injuries and even serious injuries may nevertheless result from an accidental fall into a safety net. The ability of a safety net to catch a falling object or person without injury is a direct function of the ability of the safety net to absorb the energy of the falling object or person. As a general proposition, the greater the effective distance of deceleration imparted by the safety net, the less effective force of resistance or stress is exerted by the net against the falling object or person. The likelihood of injury resulting from a fall is inversely proportional to the characteristic force of resistance of the safety net.

The ability of a safety net to absorb a load is a function of the composite materials of the safety net as well as the net configuration and the mounting configuration of the safety net. The ability of the net to deform upon impact is also important in attaining favorable shock absorbing characteristics for the net.

SUMMARY OF THE INVENTION

Briefly stated, the invention in a preferred form is a shock absorbing safety net having enhanced shock absorbing characteristics. When properly deployed, the safety net effectively reduces the stresses exerted against an individual who falls into the net and thus the net features favorable body ergonomic characteristics.

In one embodiment, a perimeter rope extends to form a peripheral flexible border. Mounting hardware, such as snap hooks, are attached at longitudinally spaced positions of the perimeter rope for mounting the safety net to an external structure. A mesh net which comprises a plurality of diamond meshes includes a peripheral band of alternating arrays of first and second diamond meshes having respective diamond points. A connecting cord lashes the first diamond points to the perimeter rope at a fixed position thereof. The connecting cord also laces the second diamond points to the perimeter rope so as to permit limited longitudinal displacement of the second mesh arrays along the perimeter rope. Upon deployment, an impact load on the safety net results in a generally V-shaped deformation of the perimeter rope in the vicinity of the snap hooks, and at least some of the diamond meshes of the second arrays generally elongate to a greater degree than the diamond meshes of the first arrays to at least partially absorb the impact of the load.

The diamond meshes may be three inch meshes and are preferably coated with a material which is resistant to ultraviolet radiation. The diamond mesh netting may be formed from a cord having a tensile strength of 1200 lbs. such as, for example, No. 120 nylon cord. The connecting cord may be formed from No. 33 spun nylon cord. The lashes are generally equidistantly spaced for each first diamond mesh group. The safety net is capable of withstanding and favorably absorbing an impact of at least 17,500 ft/lbs.

An object of the invention is to provide a new and improved safety net having enhanced shock absorbing characteristics.

Another object of the invention is to provide a new and improved safety net which reduces the potential from serious injury due to an impact in the net while also automatically returning to a normal non-impact mode after removal of the impact load from the net.

A further object of the invention is to provide a new and improved safety net which has enhanced shock absorbing characteristics and which may be manufactured in an efficient and cost effective manner.

Other objects and advantages of the invention will become apparent from the drawings and the specification.

DETAILED DESCRIPTION OF THE PREFERRED EMBODIMENT

Figure 1:
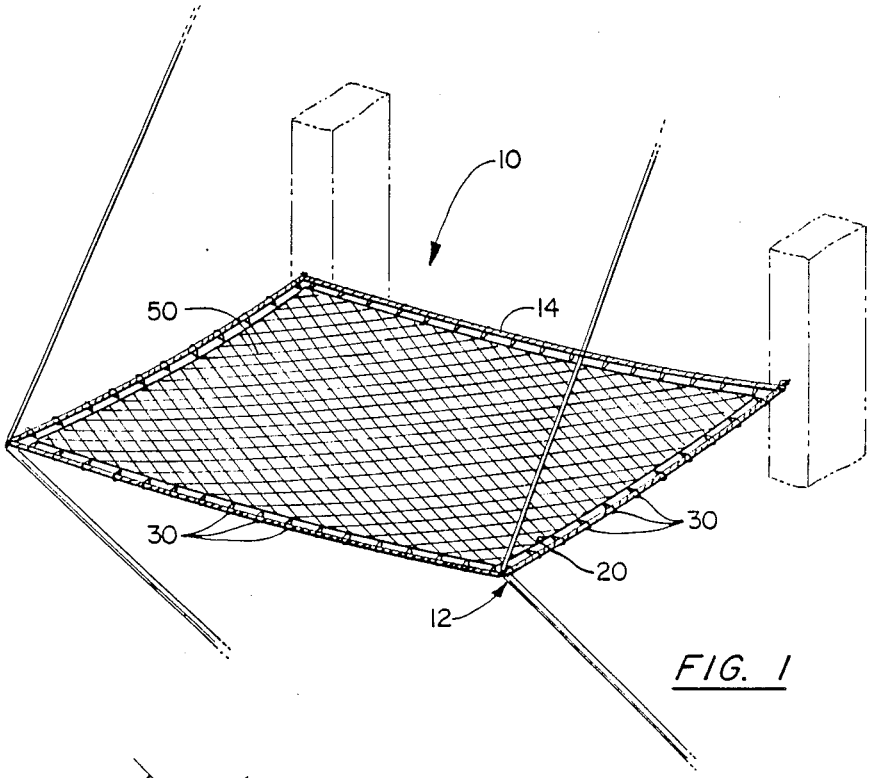
FIG. 1 is a simplified perspective view of a shock absorbing safety net in accordance with the present invention.

With reference to the drawings wherein like numerals represent like parts throughout the figures, a shock absorbing safety net in accordance with the present invention is generally designated by the numeral 10. Safety net 10 is mounted in a conventional fashion by means of a support assembly 12 (FIG. 1) which may assume a wide variety of styles, configurations and dimensions. The safety net 10 is ordinarily mounted below a structure from which an accidental fall is intended to be prevented, such as at a construction site or other hazardous structures.

The safety net 10 comprises a perimeter rope 20 which extends the circumferential perimeter of the safety net. The perimeter rope may be a one-half inch thick nylon rope. The perimeter rope connects with the support assembly via heavy duty metal snap hooks 30 of conventional form and function. The hooks are spaced along the perimeter rope 20 with the rope extending through closed eyes of the hooks. For example, the hooks may be spaced approximately every four feet and are staggered at opposite sides of the net. The hooks 30 are flared and smoothed to prevent chaffing of the rope 20. The hooks are preferably longitudinally fixed along the rope 20 by individual lash cords 32 or other suitable means. The snap hooks 30 may connect with one or more cables 14 of the support assembly 12.

The safety net is principally comprised of a diamond cord mesh 50 which typically comprises generally uniform 3 inch, 3 ½ inch or 4 inch meshes. The cord mesh is preferably formed from a twisted three strand No. 120 nylon cord. The net is treated with an ultraviolet resistant coating which also bonds the knots of the mesh.

The safety net 10 comprises a shock absorbing structure which is generally positioned at the mesh periphery and is integrated with the mesh 50. The shock absorbing assembly may assume a number of forms. In one embodiment, a lash cord 60 which may, for example, be a two strand No. 33 spun nylon cord, is employed for attaching the mesh to the perimeter rope 20. The lash cord 60 may be somewhat "fuzzy" so it knots and locks the mesh and the perimeter rope in an effective manner.

Figure 2:
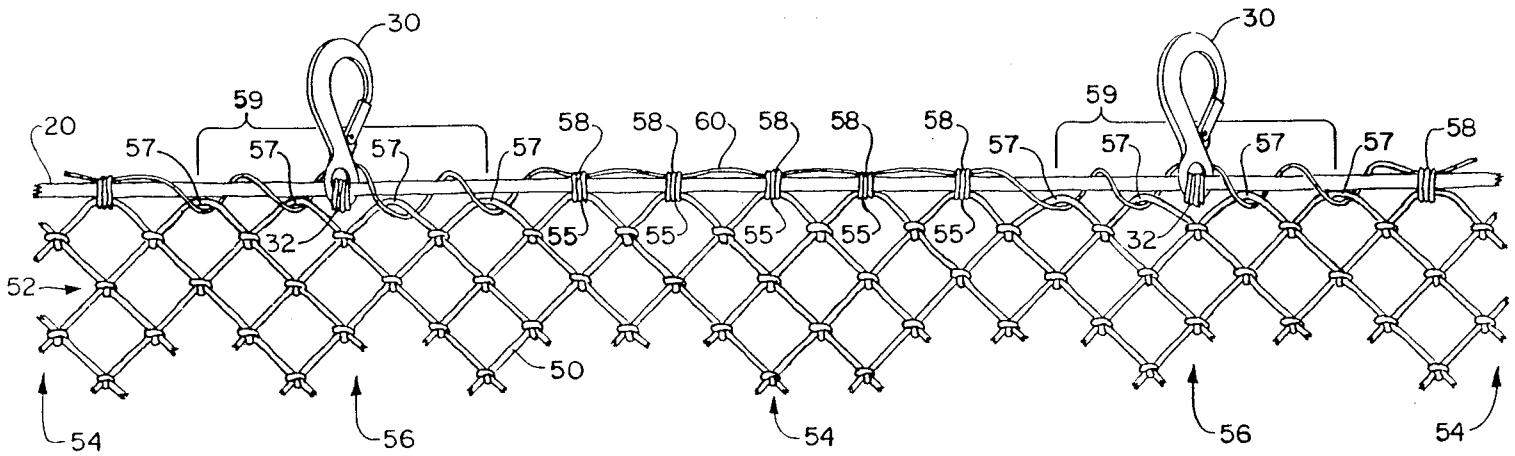
FIG. 2 is an enlarged fragmentary top view of the safety net of FIG. 1, said safety net being illustrated in a non-impact configuration.
Figure 3:
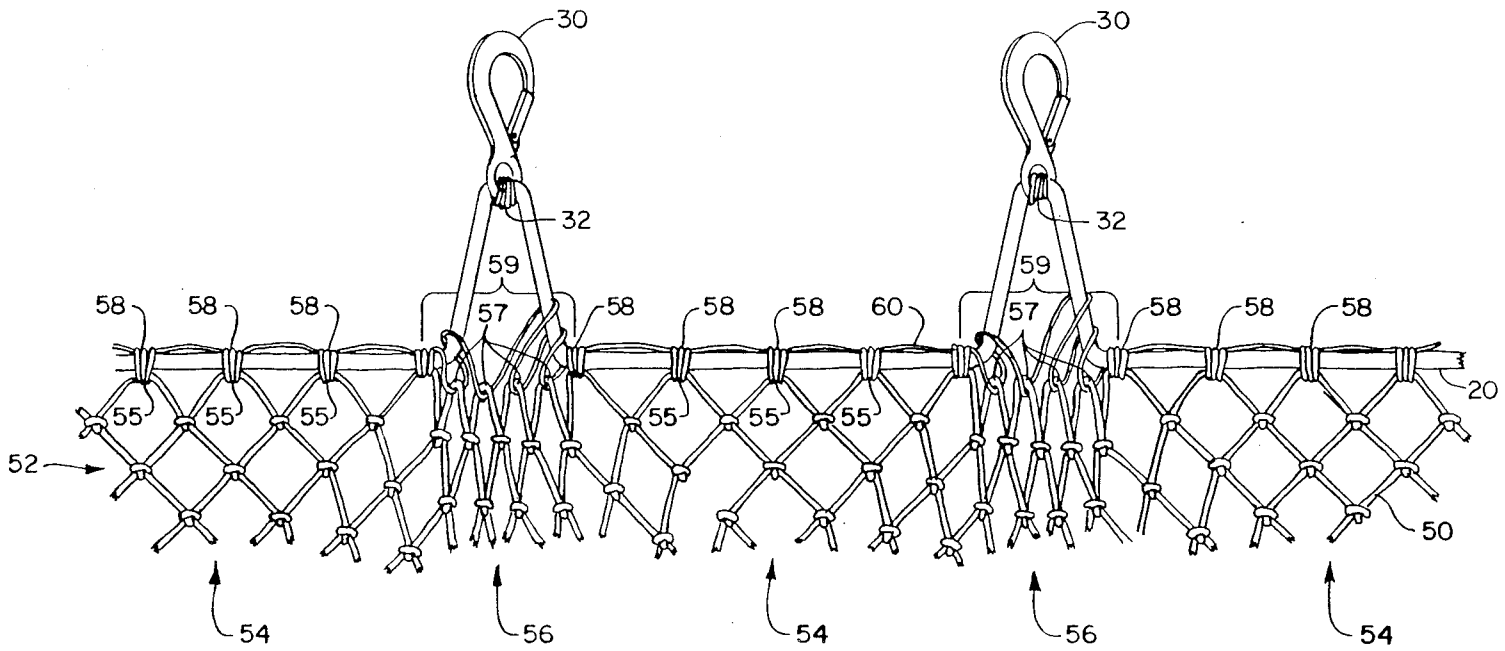
FIG. 3 is an enlarged fragmentary top view of a second embodiment of the shock absorbing safety net of FIG. 1, said safety net being illustrated in an impact configuration.

With reference to FIG. 2 and 3, the peripheral diamond meshes 52 may be viewed as comprised of a peripheral band of alternating arrays of meshes designated respectively generally by the numerals 54 and 56. Each of the diamond meshes have associated peripheral diamond points 55 and 57, respectively. Each array may have four meshes. Other array groupings are also possible.

The lash cord 60 directly lashes the diamond meshes of the arrays 54 at diamond points 55 to the perimeter rope 20 by a series of fixed double loop lashes 58 along the perimeter rope. The lash cord 60 laces (not lashes) through the meshes at diamond points 57 of the second arrays 56 and loops around the perimeter rope 20 to form a lace segment 59 so that the meshes of the second arrays are loosely attached, i.e., non-fixed, to the perimeter rope in the vicinity of the snap hooks. Thus, the peripheral diamond points 55 are lashed at fixed locations along the perimeter rope 20, and the peripheral diamond points 57 are laced to allow limited movement of the second array meshes along the rope 20.

Figure 4:
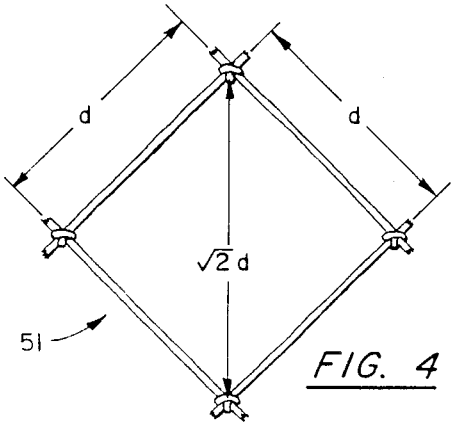
FIG. 4 is an enlarged fragmentary top view, partly in schematic, of a mesh of the safety net of FIG. 1.
Figure 5:
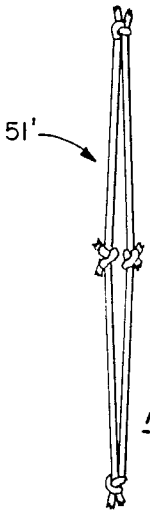
FIG. 5 is a second schematic view of the safety net mesh of FIG. 4 illustrating the shock absorbing principle thereof.
Figure 6:
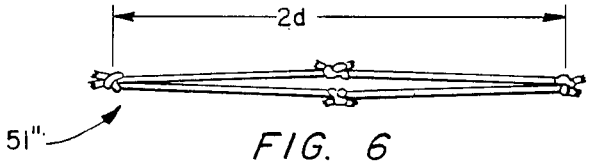
FIG. 6 is a third schematic view of the safety net mesh of FIG. 4 illustrating the shock absorbing principle thereof.

Because of the alternate lashing and lacing of the diamond mesh net to the perimeter rope, upon receiving an impact load, the perimeter rope 20 transforms from a quasi-linear configuration (FIG. 2) to a configuration of spaced quasi-inverted V-shaped segments (FIG. 3). The V-shaped segments at least in part result from lateral convergent displacement of the lace segments 59 of the lash cord 60. The diamond meshes of the second arrays 56 are thus deformable to a greater extent since the longitudinal spacing of the diamond meshes is not fixed as is the case with the first diamond arrays 54. Consequently, upon receipt of the impact, the meshes 51 (FIG. 4) of the second array of diamond meshes are deformably transformable to the mesh configurations 51' and 51'' as schematically illustrated in FIGS. 5 and 6.

The deformation may be viewed as a mesh elongation imposing a greater distance of deceleration to the impact load (2d for meshes 51' and 51'';

$$\sqrt{2}$$

d for mesh 51, where d is the length of each side of mesh 51), thus enhancing dissipation of the impact load and resulting in a diminished force of resistance exerted against the falling load. The increased distance of deceleration reduces the severity of the impact by the load and the possibility of injury to a falling individual. By increasing the effective distance of deceleration, the capacity of the safety net to withstand a given impact load is increased. For a given impact, not all meshes 51 will be transformed to the mesh configurations 51' or 51'' which are illustrative of the shock absorbing feature for at least some of the meshes during an impact.

It should be appreciated that the safety net essentially activates at the point of maximum stress, e.g., through the snap hooks 30 where the net is attached to the support cable. By pulling the perimeter into the described inverted V-shapes, the net essentially dimensionally increases and will absorb more impact energy. The increase in the effective width or length of the net as partially illustrated in FIGS. 3, 5 and 6 would result in a decrease in the corresponding transverse dimension. It should also be appreciated that the foregoing deformation essentially displaces more meshes to the impact area, thus effectively placing more mesh mass, and consequently more strength, under the area of impact.

The dimensional stability of the safety net is maintained by the lashes 58 which fixedly lash the first set of diamond points 55 to the perimeter rope 20. The lace segments 59 resiliently allow for the net to be returned to the normal spacing of the non-impact configuration (FIG. 2) upon removal of the impacting load from the safety net. If there is otherwise no damage to the safety net, the safety net is thus automatically redeployed to the non-impact configuration. Manual repositioning or replacement of the net after removal of the impact load is not required. The net is thus not removed from service or rendered inoperative due to an impact.

The shock absorbing safety net can be manufactured in an efficient and cost effective manner which does not require any significant modification to the conventional diamond mesh net as such. The principal departure from the conventional safety net manufacturing resides in the manner in which the diamond mesh netting is alternately lashed and laced to the perimeter cord. A shock absorbing safety net as described has been constructed and found to withstand an impact load in excess of 17,500 ft./lbs. Upon removal of the impact load, the safety net essentially automatically resumed its original configuration.

While the foregoing invention has been set forth for purposes of illustration, the foregoing description should not be deemed a limitation of the invention herein. Accordingly, various modifications, adaptations and alternatives may occur to one skilled in the art without departing from the spirit and the scope of the present invention.

What is claimed is:

1. A safety net comprising:

border means comprising a generally continuous perimeter member extending longitudinally to define a peripheral flexible border;

mounting means attached at longitudinally spaced positions of said perimeter member for mounting said safety net to an external structure;

mesh net means comprising a diamond mesh net comprising a peripheral band of alternating arrays of first and second diamond meshes having respective diamond points;

connecting means comprising a connecting cord for lashing said first diamond points to said perimeter member at fixed positions thereof and lacing said second diamond points to said perimeter member so as to permit limited longitudinal displacement of said second diamond points along said perimeter member, so that an impact load against said safety net results in a generally V-shaped deformation of said perimeter member at the vicinity of a said mounting means and at least some of said second diamond meshes generally elongate to a greater degree than said first diamond meshes to at least partially absorb the impact of said load.

2. The safety net of claim 1 wherein the mounting means comprises snap hooks and the hooks are disposed between adjacent second diamond meshes.

3. The safety net of claim 1 wherein the diamond meshes are three inches.

4. The safety net of claim 1 wherein the diamond mesh netting is coated with a material which is resistant to ultraviolet radiation.

5. The safety net of claim 1 wherein the diamond mesh netting is formed from cord having a tensile strength of at least 1200 lbs..

6. The safety net of claim 1 wherein the connecting means comprises No. 33 spun nylon cord.

7. The safety net of claim 1 wherein the lashes are generally equidistantly spaced for each first diamond mesh group.

8. The safety net of claim 1 wherein the net is capable of withstanding an impact of at least 17,500 ft.-lbs.

9. The safety net of claim 1 wherein the first and second arrays each comprise four meshes.

10. A safety net comprising:

border means comprising a generally continuous perimeter rope extending longitudinally to define a peripheral flexible border;

mounting means attached at longitudinally spaced positions of said perimeter rope for mounting said safety net to an external structure;

mesh net means comprising a diamond mesh net comprising a band of diamond meshes;

shock absorbing means connecting between said perimeter rope and at least some of the meshes of said band;

so that an impact load on said safety net results in an elongational deformation of said shock absorbing means to allow limited longitudinal displacement of a portion of said meshes of said band to thereby at least partially absorb the impact of said load.

11. The safety net of claim 10 wherein the mounting means comprises snap hooks mounted at fixed positions along said perimeter rope.

12. The safety net of claim 10 wherein upon impact a plurality of meshes are displaced to the vicinity of said impact.

13. The safety net of claim 10 wherein said shock absorbing means comprises cord means for connecting some meshes of said band in fixed relationship to said perimeter rope and connecting other meshes of said band to said perimeter rope to allow displacement therealong.

14. The safety net of claim 13 wherein arrays of meshes of said band are alternately connected in fixed and non-fixed relationship to said perimeter rope.

15. A safety net comprising:

border means comprising a generally continuous perimeter rope extending longitudinally to define a peripheral flexible border;

mesh net means comprising a diamond mesh net comprising a peripheral band of first and second diamond meshes;

connecting means comprising a connecting cord for lashing said first diamond meshes to said perimeter rope at fixed positions thereof and lacing said second diamond meshes to said perimeter rope so as to permit limited longitudinal displacement of said second diamond meshes along said perimeter rope, so that an impact load against said safety net results in at least some of said second diamond meshes being longitudinally displaced relative to said perimeter rope and generally transversely elongating to a greater degree than said first diamond meshes to at least partially absorb the impact of said load.

16. The safety net of claim 15 wherein the first and second diamond meshes are grouped in alternating first and second arrays with each first array and each second array comprising at least two diamond meshes.

17. The safety net of claim 15 wherein the connecting cord loops through the second diamond meshes and around the perimeter rope to lace said second diamond points to said perimeter rope.

* * * * *